US006729837B1

(12) United States Patent
Ono et al.

(10) Patent No.: US 6,729,837 B1
(45) Date of Patent: May 4, 2004

(54) SHEET FEEDER AND SHEET FEEDING METHOD

(75) Inventors: Tsukasa Ono, Kanagawa (JP); Takashi Koizumi, Kanagawa (JP); Yoshinori Kawamura, Kanagawa (JP); Kazuhisa Okamoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/664,442

(22) Filed: Sep. 18, 2000

(30) Foreign Application Priority Data

Sep. 17, 1999 (JP) ..... 11-263874

(51) Int. Cl.[7] ..... B65H 3/08

(52) U.S. Cl. ..... 414/797; 414/795.4; 414/796.5; 294/65; 271/91; 271/106; 271/107

(58) Field of Search ..... 414/797, 796.5, 414/797.8, 795.4; 294/65; 271/91, 106, 107

(56) References Cited

U.S. PATENT DOCUMENTS 3,694,020 A * 9/1972 Becker et al. ..... 294/64.1
4,674,785 A * 6/1987 Riesenberg ..... 294/65
4,940,221 A * 7/1990 Wirz et al. ..... 271/107
5,263,699 A * 11/1993 Selak et al. ..... 271/15
5,653,575 A * 8/1997 Park et al. ..... 414/797
5,685,589 A * 11/1997 Kikuchi et al. ..... 294/65
5,738,014 A * 4/1998 Rombult et al. ..... 101/477

FOREIGN PATENT DOCUMENTS

JP 1-321228 A * 12/1989 ..... 271/98
JP 8-333038 12/1996 ..... B65H/5/22
JP 9-127704 5/1997 ..... G03F/7/22
JP 10-273242 10/1998 ..... B65H/3/08

OTHER PUBLICATIONS

Translation of 1–321228, "Device for feeding and transporting a sheet" by Yuichi Nakamura.*
Patent Abstracts of Japan 08333038 Dec. 17, 1996.
Patent Abstracts of Japan 09127704 May 16, 1997.
Patent Abstracts of Japan 10273242 Oct. 13, 1998.

* cited by examiner

*Primary Examiner*—Eileen D. Lillis
*Assistant Examiner*—Michael Lowe
(74) *Attorney, Agent, or Firm*—Sughrue Mion, PLLC

(57) ABSTRACT

A sheet feeder for use with a stack having plates and sheets alternating. Sheets are removed by being reliably suction adhered with a sucker. The sheet feeder includes a suction device, and the sucker and device are mounted at a supporting portion. In order to allow suction adhering of the plates and sheets alternately stacked in a magazine, the suction device is operated when the sucker is brought into contact with the sheet, and the sheet is raised separately from the plate. Thereafter, the sheet is suction adhered to the sucker by suction. This makes it possible to prevent the sucker from suction adhering to the plate together with the sheet, and only the sheet is reliably removed from the stack.

6 Claims, 8 Drawing Sheets

SHEET FEEDER AND SHEET FEEDING METHOD

BACKGROUND OF THE INVENTION

1. Field of the Invention

The present invention relates to a sheet feeder and a sheet feeding method, for plate-shaped members such as printing plates, which are taken out one-by-one from a state in which plate-shaped members and interleaf papers for protecting printing surfaces of the plate-shaped members are alternately stacked with one another.

2. Description of the Related Art

A technique has been developed, wherein a printing plate such as a photopolymer plate having a photosensitive layer (for example, a photopolymerization layer) provided on a support is used and an image is directly recorded on the photosensitive layer (photopolymerization layer) of the printing plate by a laser beam or the like (an automatic exposure apparatus for printing plates). In such a technique, an image can be rapidly recorded on the printing plate.

In the automatic exposure apparatus for printing plates for image recording on printing plates, a magazine accommodates a large number of printing plates in a stack, and the printing plates are removed from the magazine one-by-one and transferred to an exposure section.

There are cases in which the printing plates may be stacked with interleaf papers interposed therebetween so as to protect the printing surfaces of the plates. Due to the printing plates and the interleaf papers being alternately stacked with one another, scratching or the like of the light-sensitive layer and the support for a printing plate adjacent thereto, contacting each other, is substantially prevented.

On the other hand, in a sheet feeder, the uppermost printing plate within the magazine is taken out one-by-one with a sucker (suction cup). In the sheet feeder at this time, first the interleaf paper which covers the uppermost printing plate is taken out by suction. Thereafter, the uppermost printing plate is sucked to the sucker and removed from the magazine.

However, in this arrangement in which interleaf papers and printing plates are alternately stacked, an interleaf paper and a printing plate adjacent thereto can stick together. Therefore, there is a disadvantage in that when the interleaf paper is adhered to a sucker, a printing plate disposed immediately below the interleaf paper is lifted up together with the interleaf paper.

SUMMARY OF THE INVENTION

The present invention has been devised in view of the above-described circumstances, and an object thereof is to provide a sheet feeder in which when plate-shaped members such as printing plates and sheet materials such as interleaf papers, of which rigidity or weight is lower than that of the plate-shaped members, are alternately stacked, the plate-shaped members and the sheet materials can be more reliably removed one at a time.

In accordance with a first aspect of the present invention, there is provided a sheet feeder in which plate-shaped members and sheet materials in a state of being alternately stacked are taken out one by one, comprising: at least one sucker which adheres to the plate-shaped members and sheet materials due to negative pressure by being brought into contact with the plate-shaped members and sheet materials; a suction fan which operates at a position close to a sheet material disposed at the uppermost position and sucks in air in the vicinity of the surface of the sheet material; and an elevator which moves the sucker and the suction fan in directions of approaching and moving apart from the stacked plate-shaped members and/or sheet materials, to thereby raise a plate-shaped member and/or a sheet material, which is adhered to the sucker.

According to the present invention, a sucker and suction fan are provided. The sucker suction adheres to elevate the plate-shaped member and the sheet material. The suction fan draws in air in the vicinity of the surface of the sheet material for suction adherence to the sucker to thereby suction adhere to and raise the sheet material. Although the suction force of the suction fan is smaller than that of the sucker, the sheet material can be removed from an underlying plate-shaped member by suction from the fan in the vicinity of the surface of the sheet material.

By means of the above-described suction fan, the sheet material is reliably separated from the plate-shaped member and can be removed by suction adherence to the sucker.

In accordance with a second aspect of the present invention, there is provided a sheet feeder in which plate-shaped members and sheet materials in a state of being alternately stacked are taken out one by one, comprising: a pair of side plates; a suction portion which is supported between the side plates in a movable manner in a direction perpendicular to the plate-shaped members and/or the sheet materials placed in a stack, and adheres to the plate-shaped members and/or sheet materials due to negative pressure; a suction device which is supported between the side plates in a movable manner in a direction perpendicular to the plate-shaped members and/or the sheet materials placed in a stack, and when the sheet material is disposed at the uppermost position, the suction device being operated at a position adjacent to the sheet material and sucking in air in the vicinity of the surface of the sheet material; an elevator which moves the suction portion and the suction device in a direction perpendicular to the plate-shaped members and/or the sheet materials placed in a stack to thereby elevate a plate-shaped member and/or a sheet material, stuck to the suction portion; and a sensor which is provided between the side plates so as to be movable in a direction substantially parallel to a direction in which the suction portion is movable, and detects and determines a state in which the suction portion and the plate-shaped member and/or sheet material contact each other.

In the present invention, preferably, when the sheet material is disposed at the uppermost position, the suction fan is operated in a state of being moved close to the sheet material, and thereafter, negative pressure is applied for the sucker at a predetermined timing to allow the sucker to adhere to the sheet material.

According to the aforementioned, in order to allow suction of the sheet material, first, the suction fan is operated to raise the sheet material from the plate-shaped member. Thereafter, the sheet material is suction adhered to the sucker. Since the suction force of the suction fan is smaller than that of the sucker, there is reduced the possibility of suction adhering the plate-shaped member together with the sheet material, and only the sheet material is lifted.

As a result, the sheet material is adhered to the sucker in a state in which the sheet material and the plate-shaped member closely contact each other. Therefore, the plate-shaped member is prevented from being sucked together with the sheet material, and only the uppermost sheet material can reliably be removed from an underlying plate-shaped member.

Further, in the present invention, preferably, the suction fan is operated in a state in which the sucker is brought into contact with the sheet material.

According to the aforementioned, with the sucker brought into contact with the sheet material, the suction fan is operated at the position in which for example, wind force of the suction fan applied onto the sheet material becomes maximum, to partially raise the sheet material. Subsequently, the sheet material is removed from an underlying plate-shaped member, and thereafter, the sheet material is suction adhered to the sucker.

At this time, preferably, the sucker and suction fan are moved so that the sheet material is separated from the plate-shaped member, and the sheet material is moved upward away from the plate-shaped member. Thereafter, the sheet material is suction adhered to the sucker by suction.

Moreover, in the present invention, preferably, the suction fan is provided so as to face one end of the sheet material.

According to the aforementioned, the suction fan is disposed so as to face an end, such as a peripheral edge, of the sheet material. As a result, the sheet material can more easily be separated from the plate-shaped member due to the suction force of the suction fan.

Still further, in the present invention, preferably, the suction fan is provided in the proximity of at least one of the suckers.

According to the aforementioned, the suction fan and the sucker are disposed adjacent to each other, and a region of the sheet material raised by the suction fan is suction adhered to the sucker. As a result, only the sheet material can be reliably lifted away from an underlying plate-shaped member.

In accordance with a third aspect of the present invention, there is provided a sheet feeding method in which first materials having high rigidity and second materials having flexibility in a state of being alternately stacked are taken out one by one from a magazine, comprising the steps of: (a) making a determination as to whether a material disposed at the uppermost position of the stacked materials is the first material or the second material; (b) when it is determined that the second material is disposed at the uppermost position, causing at least one sucker to abut against the uppermost material; (c) sucking in air in the vicinity of the surface of the uppermost material by a suction device; (d) moving the suction device upward by a small distance to separate the uppermost material from the stacked materials; (e) feeding negative pressure for the sucker to cause the sucker to adhere to the uppermost material; (f) stopping operation of the suction device; (g) moving upward the sucker and the suction device to completely separate the uppermost material from the stacked materials; (h) delivering the adhered uppermost material to a conveying portion; and (i) stopping application of negative pressure for the sucker.

BRIEF DESCRIPTION OF THE DRAWINGS

FIG. 6A illustrates a state prior to removal of interleaf paper; FIG. 6B illustrates a state in which the sucker is moved downward to contact the interleaf paper; FIG. 6C illustrates a state immediately after the suction fan has been operated; FIG. 6D illustrates a first-stage rising step in which the interleaf paper is lifted up to such a degree that the photopolymer plate is slightly pressed by the sucker; FIG. 6E illustrates a second-stage rising step in which the interleaf paper is lifted up to such a degree that the photopolymer plate is not pressed by the sucker; and FIG. 6F illustrates a state in which the suction fan is stopped with the interleaf paper adhered to the sucker.

DESCRIPTION OF THE PREFERRED EMBODIMENTS

Figure 1:
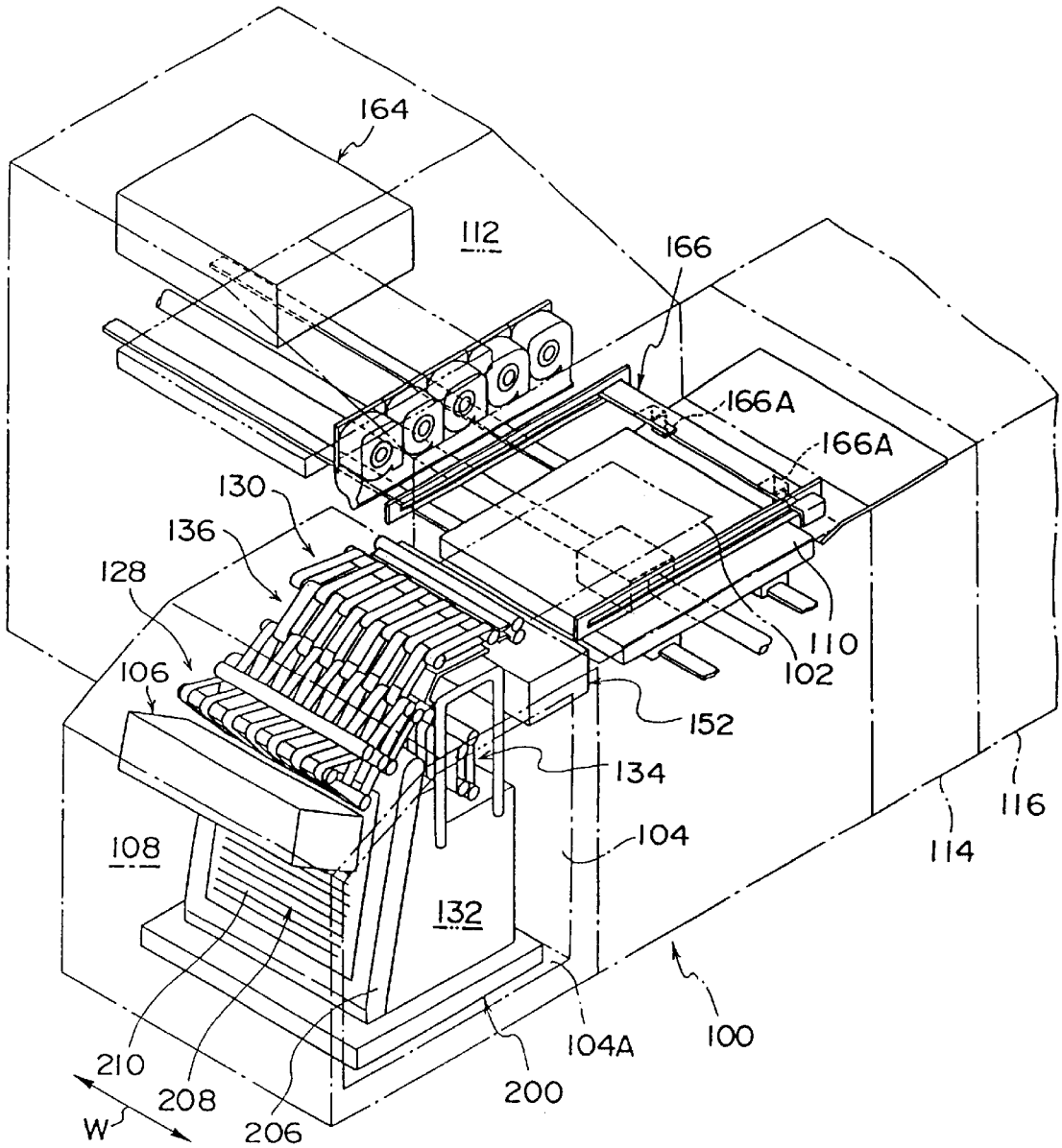
FIG. 1 is a structural diagram which schematically shows an automatic exposure apparatus in accordance with the present invention.

FIG. 1 shows an automatic exposure apparatus 100 for photopolymer plates according to an embodiment of the present invention.

The automatic exposure apparatus 100 includes a sheet feeding section 106 by which a plate accommodating section 104, in which photopolymer plates 102 (see FIG. 3) placed on a carriage 200 are accommodated, and the photopolymer plates 102 accommodated in the plate accommodating section 104 are removed and a surface table 110 for positioning and holding the photopolymer plates 102, a plate supplying section 108 for transferring the photopolymer plates 102 removed by the sheet feeding section 106 to the surface table 110, and an exposure section 112 in which an image is recorded on a photopolymer plate 102 positioned on the surface table 110.

An automatic processing apparatus 116 can be provided at a downstream side of the automatic exposure apparatus 100 via a buffer section 114, and supplying of plates, exposure, and processing can all be automatically processed.

Figure 2:
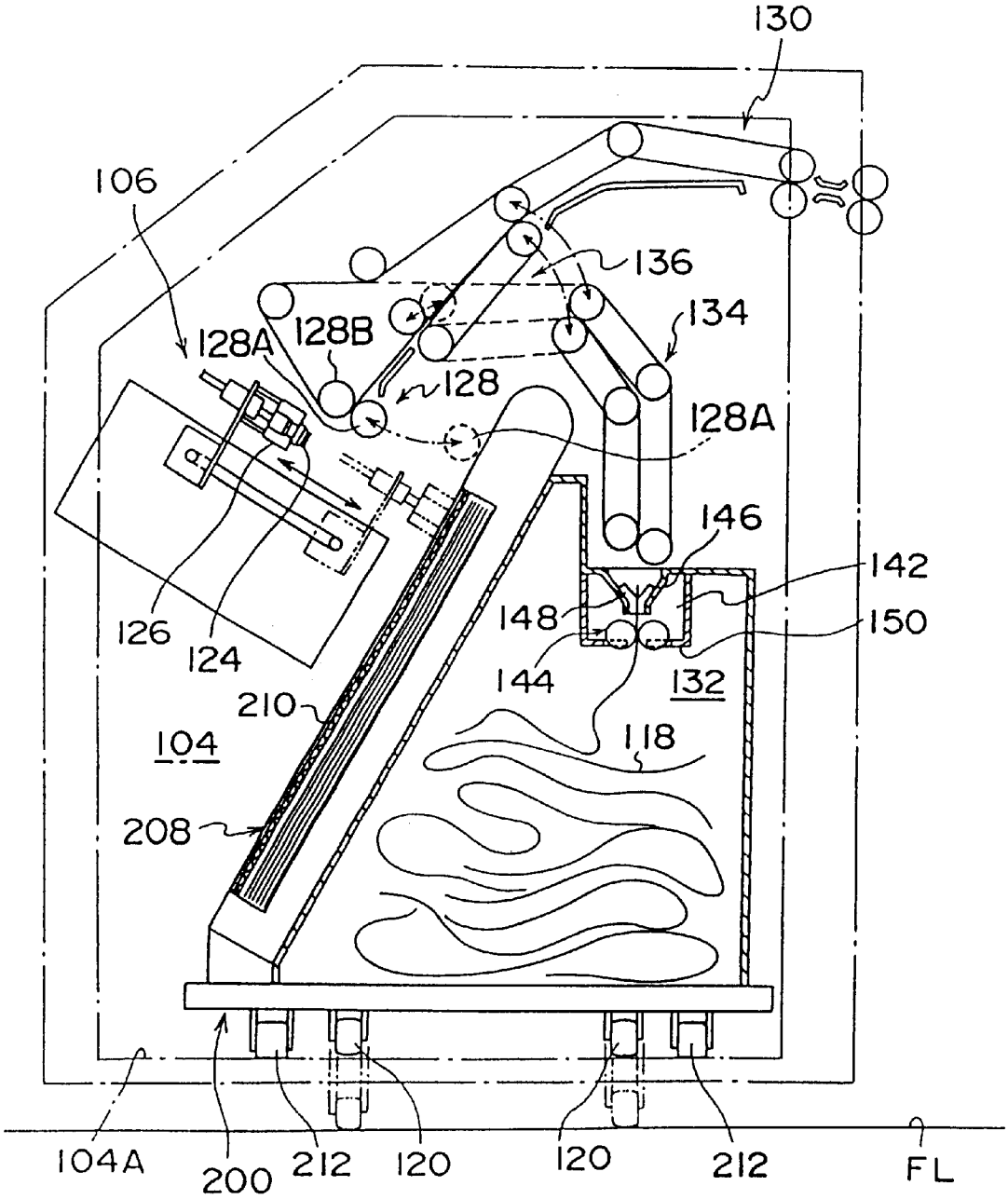
FIG. 2 is a structural diagram which schematically shows the main portion of the automatic exposure apparatus having the sheet feeding section to which the present invention is applied.

As illustrated in FIG. 2, the carriage 200 in which plural photopolymer plates 102 are placed against an inner wall thereof can be accommodated in the plate accommodating section 104.

The plate accommodating section 104 includes a floor portion 104A at a position higher than the floor surface, and the carriage 200 is formed so as to ride on the floor portion 104A above the floor surface. That is, the carriage 200 is supported via casters 120 with respect to the floor surface and the casters 120 can each be moved to a position at which it projects from the carriage 200 (that is, the position indicated by the phantom lines in FIG. 2) and also to a position at which it is accommodated in the carriage 200 (that is, the position indicated by solid lines in FIG. 2).

When the casters 120 are moved to the accommodated position in such a manner as to be made retractable toward the upper side corresponding to an operation of accommodating the carriage 200 in the plate accommodating section 104, auxiliary rollers 212 simultaneously correspond to the floor portion 104A. Thereafter, the carriage 200 is supported by the floor portion 104A via the auxiliary rollers 212.

An accumulating portion 206 is provided in the carriage 200 and a magazine 208 is mounted in the accumulating portion 206 in such a manner as to be inclined at a predetermined angle. A large number of (for example, several tens of) photopolymer plates 102 are in advance accommodated in the magazine 208 in a stack, and the photopolymer plates 102 are loaded in the plate accommodating section 104 by mounting the carriage 200 in the plate accommodating section 104.

Figure 3:
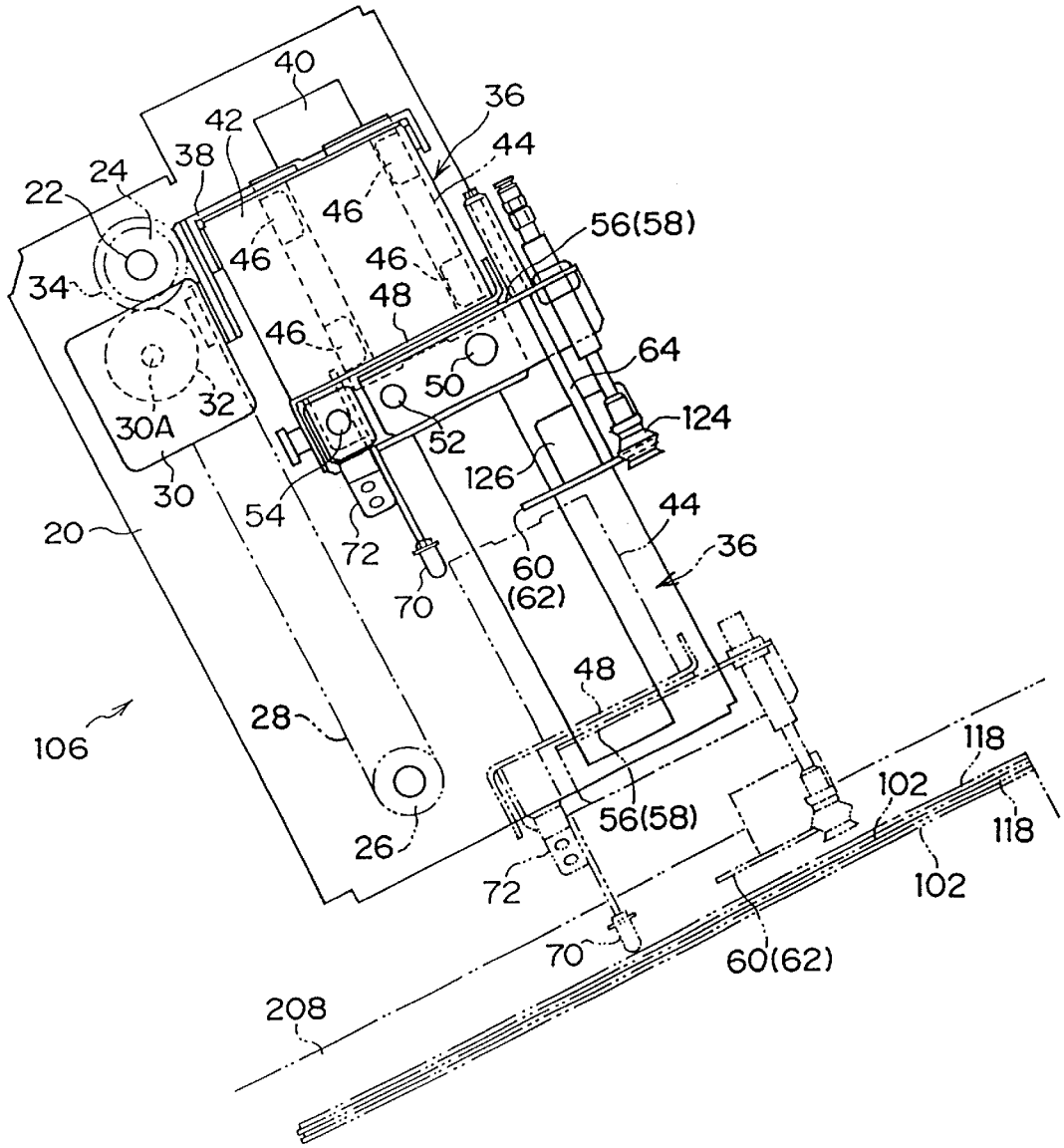
FIG. 3 is a schematic structural diagram of substantially only the sheet feeding section to which the present invention is applied.

As shown in FIG. 3, the photopolymer plates 102 are each protected in such a manner that the surface thereof (on which a light-sensitive layer formed by a photopolymerization layer is provided) is covered by interleaf paper 118. The photopolymer plates 102 and interleaf papers 118 are thus alternately stacked in the magazine 208. As shown in FIGS. 1 and 2, the magazine 208 is equipped with a shutter 210, and due to the shutter 210 being closed in cases other than when it is placed in a dark room, the photopolymer plates 102 are prevented from being undesirably exposed to light.

The photopolymer plates 102 are disposed to face the sheet feeding section 106 in a state of being inclined at a predetermined angle by mounting the carriage 200 in the plate accommodating section 104. The carriage 200 is placed in the plate accommodating section 104 and the plate accommodating section 104 is placed into a light shielding state, and the shutter 210 of the magazine 208 is opened. Therefore, the photopolymer plates 102 can be removed from the magazine 208.

The sheet feeding section 106 provided above the plate accommodating section 104 is equipped with suckers 124. A predetermined position at an upper end of each of the interleaf paper 118 and the photopolymer plate 102 adheres to the suckers 124 when operated, and the interleaf paper 118 and the photopolymer plate 102 are sequentially removed from the magazine 208 and transferred to the plate supplying section 108.

The plate supplying section 108 is mainly divided into the following four parts: a shared conveying portion 128 in which the photopolymer plate 102 or interleaf paper 118 is received from the sheet feeding section 106 and conveyed; a photopolymer plate conveying portion 130 which receives the photopolymer plate 102 and conveys the same to the surface table 110; an interleaf paper conveying portion 134 which receives the interleaf paper 118 and conveys the same to an interleaf paper receiving box 132 provided in the carriage 200; and a conveying switch portion 136 which functions as a guide from the shared conveying portion 128 to any one of the photopolymer plate conveying portion 130 and the interleaf paper conveying portion 134 by a switching operation.

As the photopolymer plates 102 and the interleaf paper 118 are alternately stacked in the plate supplying section 108, and therefore, the conveying switch portion 136 is switched each time the photopolymer plate 102 or the interleaf paper 118 is suction adhered in the sheet feeding section 106, and the photopolymer plate 102 and the interleaf paper 118 are each conveyed in a predetermined direction.

As shown in FIG. 2, in the shared conveying portion 128, a roller 128A is disposed apart from a roller 128B (indicated by the broken line in FIG. 2), and when the photopolymer plate 102 or the interleaf paper 118 is removed by the sheet feeding section 106, the roller 128A moves toward the roller 128B (indicated by the solid line in FIG. 2) and nips and conveys the leading end of the removed photopolymer plate 102 or interleaf paper 118 to the conveying switch portion 136. When the interleaf paper 118 is removed from the magazine 208, the conveying switch portion 136 is provided to switch the conveying path so as to convey the interleaf paper 118 to the interleaf paper conveying portion 134 (indicated by the broken line in FIG. 2).

The carriage 200 is provided with the interleaf paper receiving box 132, and the interleaf paper 118 removed from the magazine 208 by the sheet feeding section 106 is guided by the interleaf paper conveying portion 134 to the interleaf paper receiving box 132 provided in the carriage 200. A pair of rollers 144 is provided at an insertion opening 142 for the interleaf paper 118, which are formed in an upper side of the interleaf paper receiving box 132. These rollers are driven to rotate at a linear velocity which is slightly higher (about 1.1 times) than the conveying speed in the interleaf paper conveying portion 134. As a result, when the interleaf paper 118 extends across a region between the interleaf paper conveying portion 134 and the rollers 144, it is conveyed while maintaining a predetermined tension therein, and occurrence of jamming caused by a slack or the like can be prevented.

Further, guide plates 146 formed in such a manner that a distance therebetween (in a direction along a thickness of the interleaf paper 118) gradually decreases from top to bottom in a tapered manner, are further provided at the upstream side of the insertion opening 142 in the direction of the conveying path of the interleaf paper 118. The guide plates 146 formed in the tapered shape and facing each other. Each is provided with a charge removing brush 148 so as to remove electric charge (static electricity) from the interleaf paper 118 insertion in the insertion opening 142.

The pair of rollers 144 are skewered rollers. Partition plates 150 (disposed at the side of the rollers) have recesses which are complementary to the rollers of the skewered rollers, such that the rollers are disposed within these recesses. As a result, even if a portion of the interleaf paper 118 received in the interleaf paper receiving portion 132 contacts the rollers 144, lapping of the interleaf paper 118 around the rollers 144 can be prevented by the partition plates 150.

On the other hand, when the photopolymer plate 102 is removed from the magazine 208, the conveying switch portion 136 switches the conveying path so as to guide the photopolymer plate 102 to the photopolymer plate conveying portion 130 (indicated by the solid line in FIG. 2). As a result, the photopolymer plate 102 removed from the magazine 208 is transferred by the photopolymer plate conveying portion 130 to the surface table 110 (see FIG. 1) in a state of being conveyed substantially horizontally.

As illustrated in FIG. 1, the upper surface of the surface table 110 is disposed at a position lower than a position at which the photopolymer plate is horizontally conveyed in the photopolymer plate conveying portion 130. Further, there is a space or gap between the surface table 110 and the photopolymer plate conveying portion 130 in the direction in which the photopolymer plate is conveyed. For this reason, the photopolymer plate 102 conveyed from the photopolymer plate conveying portion 130 arrives at the surface table 110 in such a manner that the leading end thereof slightly hangs, and the trailing end of the photopolymer plate 102 in the conveying direction is positioned further at the upstream side of the surface table 110 in the conveying direction of the plate 102. A movable body 152 is provided at this upstream side of the surface table 110 so as to be capable of moving close to and apart from the surface table 110.

The movable body 152 includes a temporary supporting plate, a pressing plate, a puncher, and the like, which are all not shown. Hanging of the photopolymer plate 102 conveyed onto the surface table 110 is prevented by the temporary supporting plate.

Further, the pushing plate (not shown) provided in the movable body 152 pushes the trailing end of the photopolymer plate 102 so as to cancel a diagonal feed of the photopolymer plate 102, and the photopolymer plate 102 is conveyed to a predetermined reference position in the conveying direction. The reference position is set in such a manner that the trailing end of the photopolymer plate 102 in the conveying direction slightly protrudes from the surface table 110.

At the reference position, sensors (not shown) are respectively provided at plural positions including two corners at the trailing end of the photopolymer plate 102 in the conveying direction. Due to the trailing end of the photopolymer plate 102 being detected by the above-mentioned sensors, pushing by the pushing plate is stopped. Further, these sensors are also used to detect positions on the photopolymer plate 102 along the transverse direction perpendicular to the conveying direction. That is, the corners of the photopolymer plate 102 and the sensors are caused to coincide with each other by the surface table 110 moving in the transverse direction of the photopolymer plate 102 perpendicular to the conveying direction, and the position at which the corners of the photopolymer plate 102 and the sensors coincide with each other is registered as an initial position of the photopolymer plate 102.

The position of the photopolymer plate 102 moved to the initial position is set so as to become a relative position for a scanning/exposure starting position in the exposure section 112. In this state, the photopolymer plate 102 is sucked and held by negative pressure supplied to a suction groove (not shown) provided in the surface table 110. The puncher provided in the movable body 152 punches holes in the photopolymer plate 102 sucked and held by the surface table 110.

The surface table 110 is movable in a reciprocating manner (which is common to a movement for positioning in the transverse direction perpendicular to the conveying direction) at approximately a uniform velocity between a first position (indicated by the solid line in FIG. 1) at which the photopolymer plate 102 is received from the photopolymer plate conveying portion 130 and a second position (indicated by the phantom line in FIG. 1) at which the photopolymer plate 102 is accommodated in the exposure section 112.

In the exposure section 112, a scanning unit 164 is provided at a position above the conveying path on the surface table 110. Main scanning (in a direction perpendicular to the moving direction of the surface table 110) is carried out using laser beams which are controlled so as to be modulated on in accordance with an image signal. Forward movement of the surface table 110 is sub-scan movement. Thus, during the forward movement of the surface table 110 to the exposure section 112, an image is recorded on the photopolymer plate 102 held on the surface table 110, and the photopolymer plate 102 is moved back to an original position by backward movement of the surface table 110. After the photopolymer plate 102 placed on the surface table 110 has been moved back to the original position, vacuum application is terminated thereby releasing the plate 102.

The surface table 110 on which the photopolymer plate 102 with an image being recorded is moved back to the original position and a discharging mechanism section 166 placed in a waiting state at the side of the trailing end of the photopolymer plate 102, in the conveying direction of the plate 102 by the photopolymer plate conveying portion 130, passes above the surface table 110 and moves to the leading end of the photopolymer plate 102.

The discharging mechanism section 166 is provided with hook portions 166A for supporting the trailing end of the photopolymer plate 102. Due to the trailing end of the photopolymer plate 102 protruding from the surface table 110 being lifted up by the temporary supporting plate provided in the movable body 152 and the discharging mechanism section 166 being moved in the direction in which the photopolymer plate 102 is conveyed, the photopolymer plate 102 is conveyed to the downstream side of the surface table 110 by being caught by the hook portions 166A and accompanied with the movement of the discharging mechanism section 166. A buffer section 114 and the automatic processing apparatus 116 are sequentially provided at the downstream side of the surface table 110, and the photopolymer plate 102 is conveyed out smoothly while eliminating a difference between a speed at which it is discharged by the discharging mechanism section 166 and a speed at which it is conveyed in the automatic processing apparatus 116 by the buffer section 114.

Figure 4:
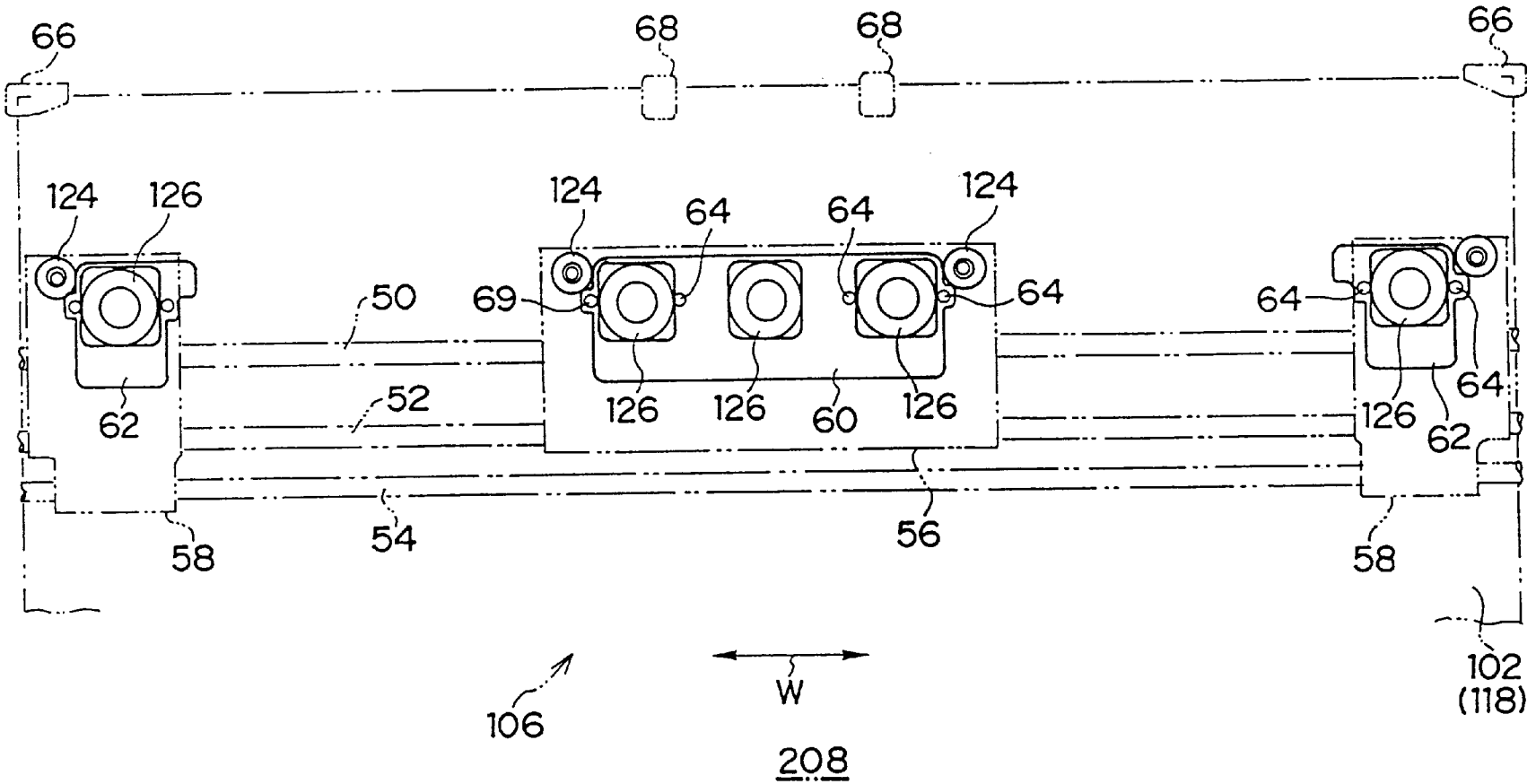
FIG. 4 is a schematic diagram which shows relative positions of a sucker and a suction fan with respect to the surface of photopolymer plates and interleaf papers accommodated in a magazine.
Figure 5:
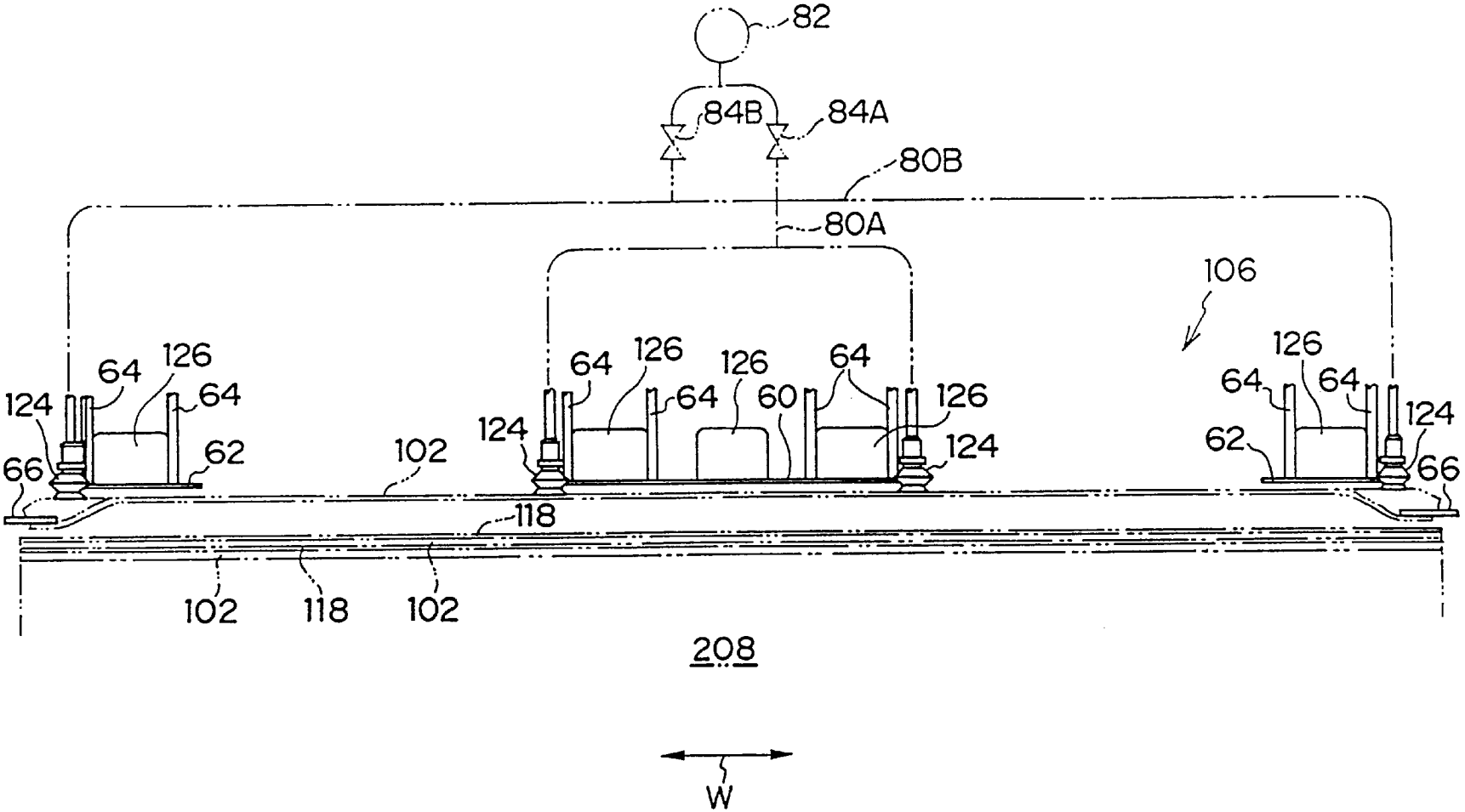
FIG. 5 is a schematic diagram showing the relative positions of the sucker and the suction fan with respect to the surface of a photopolymer plate accommodated in the magazine, when seen from a side different from the view of FIG. 4.

FIGS. 3 to 5 each show the sheet feeding section 106 to which the present invention is applied. In the embodiment of the present invention, the photopolymer plate 102, which is one kind of printing plate, is used as a plate-shaped member and the interleaf paper 118 is used as a sheet material. The photopolymer plates 102 and the interleaf papers 118 are accommodated in the magazine 208 in a state of being alternately stacked. As described above, in the sheet feeding section 106, the interleaf paper 118 and the photopolymer plates 102 are each removed from the magazine 208 and conveyed into the plate supplying section 108. In FIGS. 4 and 5, the transverse direction of the photopolymer plate 102 (i.e., the direction perpendicular to the plane of FIG. 3) perpendicular to the direction in which the photopolymer plate 102 is conveyed between the shared conveying portion 128 and the photopolymer plate conveying portion 130, is indicated by a double-headed arrow W.

As illustrated in FIG. 3, in the sheet feeding section 106, a shaft 22 is disposed spanning between a pair of side plates 20 (in FIG. 3, only one of them is shown) at upper portions of the side plates 20 (at the upper side in FIG. 3). Sprockets 24 are respectively mounted at both ends of the shaft 22 (at the sides of the side plates 20). Further, a sprocket 26 is mounted in the side plate 20 at the side of the magazine 208, and a chain 28 is entrained around the sprockets 24 and 26.

Further, an elevating motor 30 serving as an elevator is mounted at one of the side plates 20, and a gear 32 mounted on a driving shaft 30A of the elevating motor 30 meshes with a gear 34 mounted at the shaft 22. As a result, when the elevating motor 30 is driven, the sprockets 24 and 26 are rotated and the chain 28 is moved between the sprockets 24 and 26 in a direction substantially perpendicular to the surface of the photopolymer plates 102 stacked in the magazine 208.

A suction frame 36 is disposed between the side plates 20. The suction frame 36 is connected to the chain 28 via a bracket 38. Further, guide rails 40 are respectively mounted to the side plates 20 on the surfaces thereof facing each other.

The suction frame 36 is provided with side bases 42 which face the side plates 20, respectively. Sliders 44 are mounted at the side bases 42 so as to face the guide rails 40. Each of the sliders 44 is provided with a plurality of guide blocks 46 for holding the guide rail 40. As a result, when the elevating motor 30 is driven, the suction frame 36 moves along the guide rail 40 and moves up and down substantially perpendicular to the photopolymer plate 102 in the magazine 208.

The suction frame 36 includes a supporting base 48 facing the magazine 208. Three shafts 50, 52, and 54 extend through the supporting base 48 along the transverse direction of the photopolymer plate 102.

As illustrated in FIG. 4, a bracket 56 is mounted so as to straddle over the shafts 50 and 52, and a bracket 58 is mounted so as to straddle over the shafts 50, 52, and 54. The brackets 56 and 58 are mounted, for example, in such a manner that the shafts 50, 52, and 54 pass through slide blocks (not shown) provided at the rear side thereof.

The bracket 56 faces a transverse-direction intermediate portion of the photopolymer plate 102 accommodated in the magazine 208, and the brackets 58 respectively face both the transverse-direction end portions of the photopolymer plate 102. The bracket 56 is fixed at a predetermined intermediate position between the shafts 50 and 52, and the brackets 58 are disposed respectively at sides of both ends of the shafts 50, 52, and 54 and can each be moved in directions in which it moves away and towards the bracket 56 in accordance with the size of the photopolymer plate 102 accommodated in the magazine 208 (this operation is not shown).

A fan base 60 is disposed below the bracket 56 and a fan base 62 is further disposed below each of the brackets 58. The fan base 60 and the fan bases 62 are supported in such a manner as to be respectively connected to the brackets 56 and 58 by a plurality of shafts 64. As shown in FIG. 5, respective lower surfaces of the fan bases 60 and 62 are each disposed linearly and parallel to the surface of the photopolymer plate 102 accommodated in the magazine 208.

As illustrated in FIGS. 4 and 5, the fan base 60 is provided with plural (in the present embodiment, for example, three) suction fans 126 along the transverse direction of the photopolymer plate 102, and each of the fan bases 62 is provided with one suction fan 126. The suction fan 126 includes a vent opening portion at the central portion thereof, and is constructed to suck air from the fan bases 60 and 62 at the side of the magazine 208 by driving a fan motor (not shown) to blow out air upwardly (see FIG. 6A).

In the sheet feeding section 106, when the interleaf paper 118 is removed from the magazine 208, first, the suction fans 126 are operated and the interleaf paper 118 is raised by suction force due to the suction fans 126. Thereafter, the interleaf paper 118 is held by being stuck to the sucker 124.

As illustrated in FIG. 4, the bracket 56 is provided with the suckers 124 which are respectively mounted at both sides of the bracket 56 with the fan base 60 interposed therebetween. The brackets 58 are each provided with the sucker 124 mounted at an outer side of the bracket along the transverse direction of the photopolymer plate 102. As illustrated in FIGS. 4 and 5, these suckers 124 are each disposed near the suction fan 126.

As shown in FIG. 5, the suckers 124 are each connected to a negative pressure source such as a vacuum pump 82 via, for example a pipe line 80A or a pipe line 80B. Further, the pipe lines 80A and 80B are respectively provided with solenoid valves 84A and 84B. Due to the solenoid valves 84A and 84B being opened in a state in which the vacuum pump 82 is actuated, negative pressure is created at each of the suckers 124.

Figure 6A:
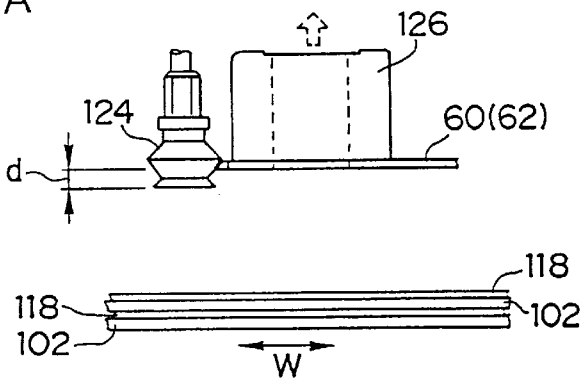
FIGS. 6A to 6F are schematic diagrams which show the flow of an interleaf paper removal operation using a sucker and a suction fan.

Further, as illustrated in FIG. 6A, an end of the sucker 124 slightly protrudes from the rear surface of the fan base 60 or 62 (that is, the surface which faces the photopolymer plate 102), and therefore, when the end of the sucker 124 abuts against the photopolymer plate 102 or the interleaf paper 118, the sucker 124 is apt to be flattened. Due to the sucker 124 being apt to be flattened by abutting against the photopolymer plate 102 or the interleaf paper 118, the photopolymer plate 102 and the interleaf paper 118 can reliably be suction adhered by the sucker 124.

In the present embodiment, as an example, a dimension d between the lower surface of the fan base 60 or 62 and the end of the sucker 124 is set to be about 3.5 mm (d=3.5 mm). When the sucker 124 contacts the photopolymer plate 102 or the interleaf paper 118, a small clearance is formed between the fan base 60 or 62, and the photopolymer plate 102 or the interleaf paper 118 without the fan base contacting the surface of the photopolymer plate 102 or interleaf paper 118. As a result, damage to the photopolymer plate 102 caused by the fan base 60 or 62 contacting the photopolymer plate 102 is prevented, and a suction efficiency of the suction fan 126 when the interleaf paper 118 is suction held by the suction fan 126 is greater.

In the sheet feeding section 106, the sucker 124 and the suction fan 126 are integrally moved up and down due to operation of the elevating motor 40 with respect to the photopolymer plate 102 (or the interleaf paper 118) accommodated in the magazine 208, and the upper end of the photopolymer plate 102 or the interleaf paper 118 accommodated in the magazine 208 is lifted up by being suction held to the sucker 124. Further, in the sheet feeding section 106, when the interleaf paper 118 is removed from the magazine 208, first, the suction fans 126 are operated so as to slightly lift up the interleaf paper 118 due to suction force of the suction fans 126, and thereafter, the interleaf paper 118 is suction adhered to the suckers 124.

As illustrated in FIG. 4, the magazine 208 is provided with separation plates 66 which are mounted so as to face both transverse-direction ends of the photopolymer plate 102. When the photopolymer plate 102 is lifted up by being suction adhered to the sucker 124, the transverse-direction ends of the photopolymer plate 102 abut against the separation plates 66 and bend. Therefore, the photopolymer plate 102 adhered to the sucker 124 is reliably separated from the interleaf paper 118 located at a rear side thereof and only the uppermost photopolymer plate 102 is caused to move upward.

Further, the magazine 208 is also provided with interleaf paper keepers 68 which face the upper end of the interleaf paper 118. When the magazine 208 is mounted on the carriage 200 in an inclined manner, the interleaf paper keepers 68 are provided to abut against the uppermost interleaf paper 118 to prevent curling and falling of the interleaf paper 118, which is typically not firm.

As illustrated in FIG. 3, the suction frame 36 is provided with a contact sensor 70. The contact sensor 70 is, for example, disposed in a transverse-direction intermediate portion of the photopolymer plate 102 (in the vicinity of the bracket 56) and protrudes from a block 72 mounted at the shaft 54 toward the magazine 208. When the sucker 124 abuts against the photopolymer plate 102 or the interleaf paper 118, the contact sensor 70 contacts the photopolymer plate 102 or the interleaf paper 118 and is placed in an on state (begins operating). That is, when the sucker 124 is moved upward, it can be confirmed by the contact sensor 70 as to whether the photopolymer plate 102 or the interleaf paper 118 is adhered to the sucker 124.

Further, the suction frame 36 is equipped with a plate/paper discrimination sensor 72. In the plate/paper discrimination sensor 72, light irradiated from a light projecting portion and reflected by the photopolymer plate 102 or the interleaf paper 118 is received by a light receiving portion by using, for example, a reflection type photosensor. At this time, an amount of the received light varies due to a difference in reflectance between the photopolymer plate 102 and the interleaf paper 118, and therefore, a determination can be made as to whether the uppermost layer is the photopolymer plate 102 or the interleaf paper 118.

The distinction between the photopolymer plate 102 and the interleaf paper 118 may also be made, using a pressure sensor provided in a pipe line for feeding negative pressure for the sucker 124, on the basis of the difference between a pressure generated when the interleaf paper 118 is suction adhered to the sucker 124, and a pressure generated when the photopolymer plate 102 is suction adhered to the sucker 124. That is, when the photopolymer plate 102 is located at the uppermost position, a predetermined negative pressure is detected by the pressure sensor. When the interleaf paper 118 is located at the uppermost position, negative pressure to be fed for the sucker 124 leaks through the interleaf paper 118 and the negative pressure to be detected by the pressure sensor is reduced (approximately to zero).

Next, operation of the present embodiment will be described.

In the automatic exposure apparatus 100, when an instruction for exposure of images on the photopolymer plate 102 is given in a state in which the carriage 200, in which the magazine 208 having the photopolymer plates 102 accommodated therein is loaded, is mounted in the plate accommodating section 104, the photopolymer plates 102 are removed.

Processing in the sheet feeding section 106 will hereinafter be described with reference to the flow chart shown in FIGS. 7A and 7B and the diagrams shown in FIGS. 6B to 6F.

Figure 7A:
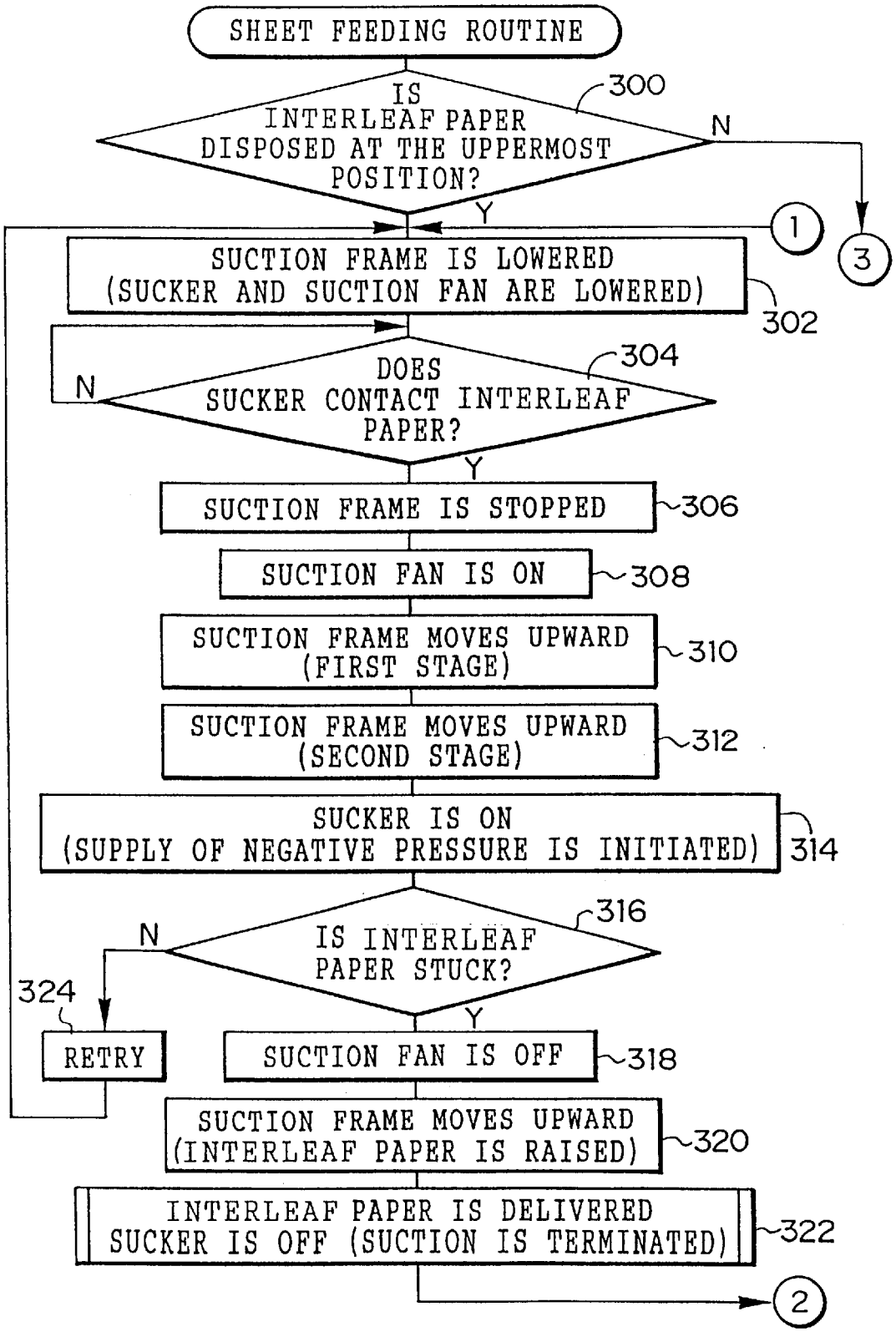
FIGS. 7A and 7B are flow diagrams which shows an example of sheet feeding process for photopolymer plates and interleaf papers in the sheet feeding section to which the present invention is applied.
Figure 7B:
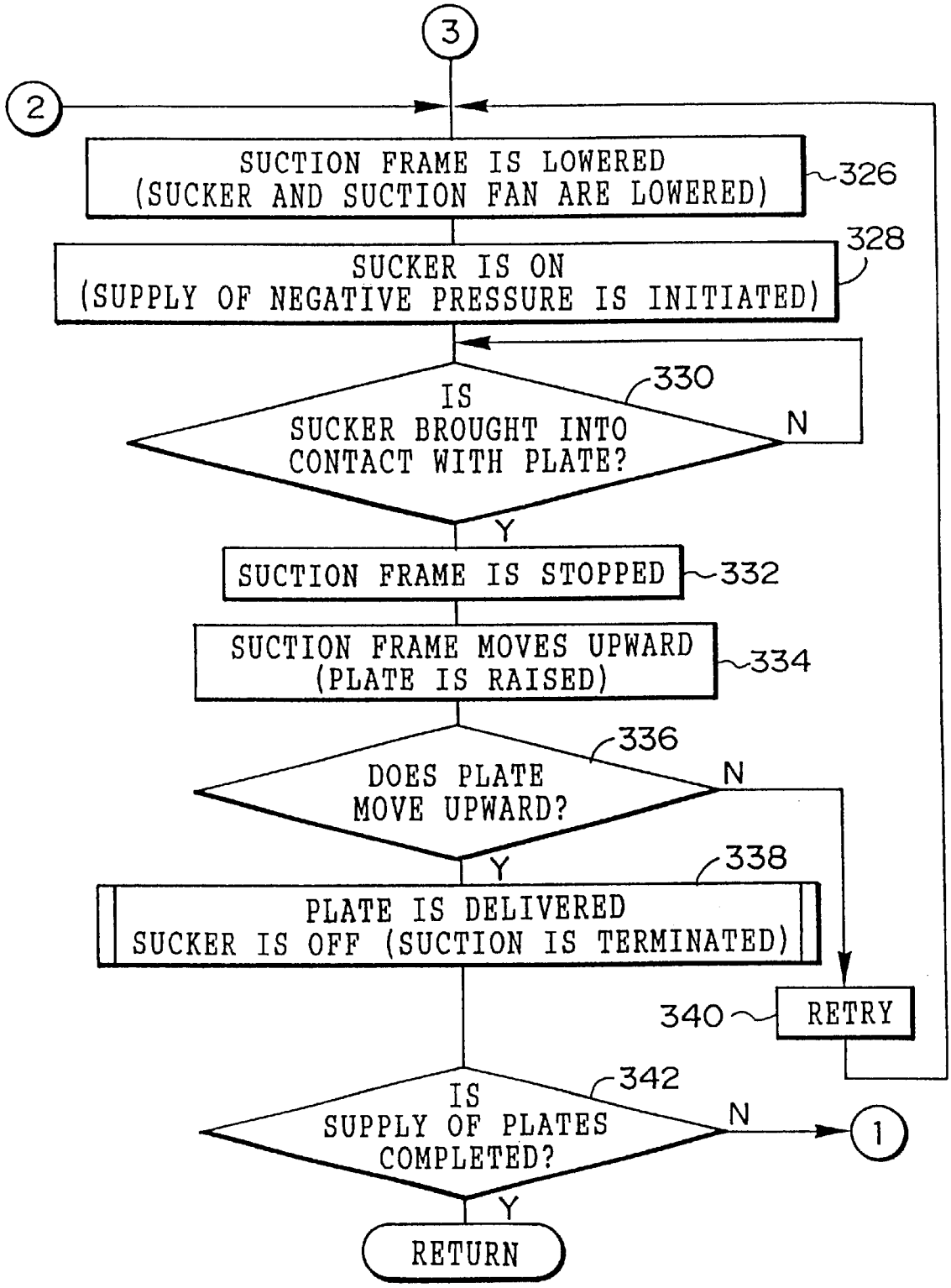

The flow chart shown in FIGS. 7A and 7B are executed when an instruction for removal of the photopolymer plate 102 is given. In the first step 300, it is confirmed as to whether the uppermost layer in the magazine 208 is the interleaf paper 118. When it is determined that the uppermost layer is the interleaf paper 118, the process proceeds to step 302, first, removal of the interleaf paper 118 is carried out. A determination as to whether the uppermost layer at this time is the interleaf paper 118 is made by the plate/paper discriminating sensor 72.

When the interleaf paper 118 is removed, the conveying path is changed by the conveying switch portion 136 so as to convey the interleaf paper 118 from the shared conveying portion 128 to the interleaf paper conveying portion 134. Further, when the uppermost layer is always the interleaf paper 118, step 300 can be omitted.

In step 302, the elevating motor 40 is operated in a state in which feeding of negative pressure for the sucker 124 and the suction fan 126 are placed in an off state (are stopped), and the suction frame 36 is moved downward (toward the magazine 208). As a result, the sucker 124 moves toward the interleaf paper 118 together with the fan bases 60 and 62 in which the suction fans 126 are mounted.

In step 304, it is determined whether the sucker 124 abuts against the interleaf paper 118 based on the determination as to whether the contact sensor 70 contacts the interleaf paper 118. When it is determined that the sucker 124 abuts against the uppermost interleaf paper 118 (when the decision of step 304 is affirmative), the process proceeds to step 306 and movement of the suction frame 36 in the downward direction is stopped (the elevating motor 40 is stopped).

Figure 6B:
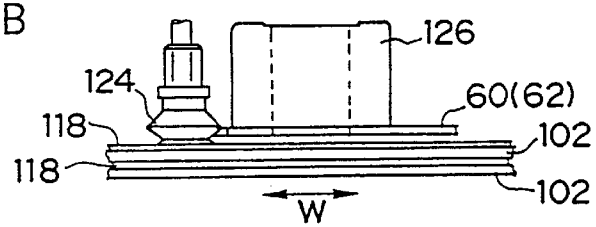

As a result, as illustrated in FIG. 6B, the fan base 60 or 62 is moved slightly apart from the interleaf paper 118, while the interleaf paper 118 is still being pressed by the sucker 124.

Figure 6C:
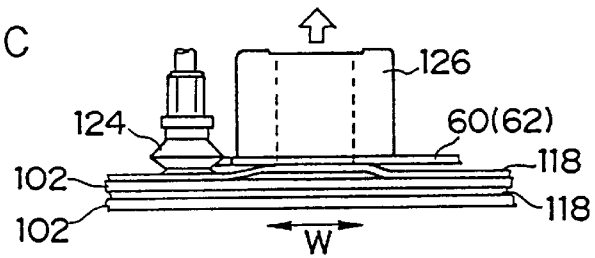

In the subsequent step 308, the suction fan 126 is turned on and the uppermost interleaf paper 118 pressed by the sucker 124 is attracted to the suction fan 126. As a result, as illustrated in FIG. 6C, the state in which the uppermost interleaf paper 118 tends to be drawn away from the underlying photopolymer plate 102 so that close contact therebetween is released.

Figure 6D:
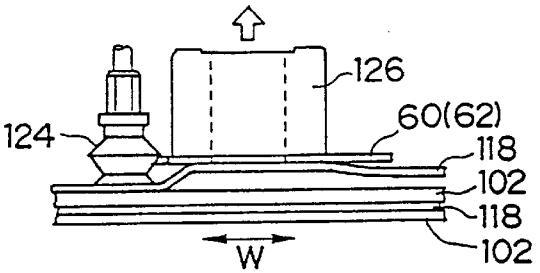

Subsequently, in step 310, the suction frame 36 is moved upward slightly (for example, by a distance of about 3 mm) while maintaining the state in which the interleaf paper 118 is pressed by the sucker 124. As a result, as illustrated in FIG. 6D, the fan base 60 or 62 is slightly lifted up and the uppermost interleaf paper 118 is partially raised due to suction force of the suction fan 126.

Figure 6E:
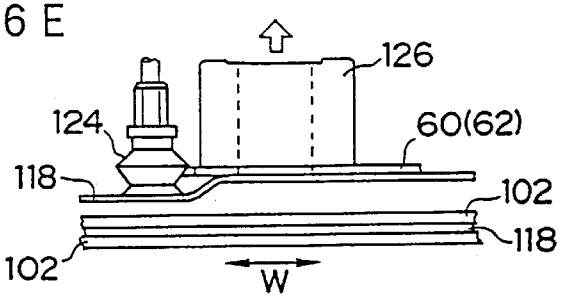

In step 312, the suction frame 36 is moved upward (for example, by a distance of about 2 mm) until the sucker 124 is raised. As a result, as illustrated in FIG. 6E, the uppermost interleaf paper 118 is released from the state of closely contacting the photopolymer plate 102 due to the suction fan 126 being separated from the photopolymer plate 102.

Figure 6F:
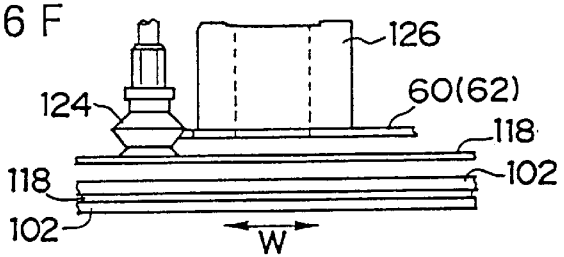

As described above, when the fan bases 60 and 62 are moved upward step by step and the uppermost interleaf paper 118 is raised away from an underlying photopolymer plate 102 due to the suction force of the suction fan 126, in step 314, negative pressure is fed for the sucker 124, for example, by opening an electromagnetic valve for feeding the sucker 124 with negative pressure, and the interleaf paper 118 is attracted to the sucker 124. As a result, as illustrated in FIG. 6F, the interleaf paper 118 is adhered to the sucker 124 and more reliably lifted away from the photopolymer plate 102.

In the present embodiment, the fan bases 60 and 62 are moved upward at two stages, but these fan bases may also be moved upward to a position corresponding to the position in step 312 in a single operation without carrying out the process of step 310.

In the subsequent step 316, it is determined whether the interleaf paper 118 is suction adhered to the sucker 124. This determination is made based on a determination as to whether the contact sensor 70 contacts the interleaf paper 118 lifted up by the sucker 124. When it is determined that the interleaf paper 118 has been lifted up by the sucker 124 (when the decision of step 316 is affirmative), the process proceeds to step 318, in which the suction fan 126 is turned off. On the other hand, the determination as to whether the interleaf paper 118 has been adhered to the sucker 124 may also be made after the suction fan 126 has been turned off (that is, step 316 may be executed after execution of step 318).

When the suction fan 126 is turned off and the interleaf paper 118 is suction adhered to the sucker 124, in step 320, the elevating motor 40 is driven in reverse to move the suction frame 36 upward. In step 322, the interleaf paper 118 is passed to the shared conveying portion 128. To pass the interleaf paper 118 to the shared conveying portion 128, the suction frame 36 is moved upward to a predetermined position and the leading end of the interleaf paper 118 thus moved upward is nipped by the rollers 128A and 128B, and application of negative pressure for the sucker 124 is stopped. As a result, the interleaf paper 118 is released from the sucker 124 while being nipped by the rollers 128A and 128B.

The interleaf paper 118 passed to the shared conveying portion 128, and conveyed from the shared conveying portion 128 to the interleaf paper conveying portion 134 via the conveying switch portion 136, while being pulled out from the magazine 208, and received in the interleaf paper receiving box 132.

When the interleaf paper 118 is not suction adhered to the sucker 124 (when the decision of step 316 is negative), the process proceeds to step 324, and retry is set in which the suction frame 36 is moved downward again and the interleaf paper 118 is removed.

When the interleaf paper 118 covering the photopolymer plate 102 is removed from the magazine 208 as described above, the process proceeds to step 326 and removal of the photopolymer plate 102 is carried out. In comparison, when the photopolymer plate 102 is located at the uppermost position in the magazine 208 and the decision of step 300 is negative, removal of the photopolymer plate 102 is immediately started. Further, in carrying out removal of the photopolymer plate 102, the conveying switch portion 136 is switched and the conveying path from the shared conveying portion 128 to the photopolymer plate conveying portion 130 is formed.

In the sheet feeding section 106, when the process proceeds to step 326, movement of the suction frame 36 in the downward direction is started. Further, in step 328, feeding the sucker 124 with negative pressure is started (the sucker 124 is activated). As a result, the sucker 124 moves downward toward the photopolymer plate 102 within the magazine 208, in a state of being capable of suction adhering to the photopolymer plate 102.

In the subsequent step 330, it is confirmed by the contact sensor 70 as to whether the sucker 124 has been brought into contact with the photopolymer plate 102, and when the contact sensor 70 is activated to cause the sucker 124 to move downward to a position at which it contacts the photopolymer plate 102 (when the decision of step 330 is affirmative), the process proceeds to step 332 and movement of the suction frame 36 in the downward direction is stopped.

Subsequently, in step 334, the sucker 124 to which the photopolymer plate 102 is stuck is moved upward by lifting up the suction frame 36, and the photopolymer plate 102 is thereby raised. At this time, in step 336, it is confirmed as to whether the contact sensor 70 is turned on, to thereby confirm whether the photopolymer plate 102 is raised by suction adherence to the sucker 124. That is, whether the photopolymer plate 102 is reliably suction adhered to the sucker 124.

When the photopolymer plate 102 is stuck to the sucker 124 (when the decision of step 336 is affirmative), the suction frame 36 is lifted as is. As a result, the uppermost photopolymer plate 102 accommodated in the magazine 208 is raised in such a manner that an upper end thereof is adhered to the sucker 124. At this time, as shown in FIG. 5, both transverse-direction ends of the photopolymer plate 102 are bent by the separation plates 66 provided in the magazine 208, and the raised photopolymer plate 102 can be separated from the interleaf paper 118 located immediately therebelow, and from a subsequent photopolymer plate 102.

When the photopolymer plate 102 is thus removed from the magazine and lifted up to a predetermined height, in step 338, the photopolymer plate 102 is passed to the shared conveying portion 128. Thereafter, the sucker 124 is turned off (application of negative pressure is stopped) and the sucker 124 releases the photopolymer plate 102.

As a result, the photopolymer plate 102 lifted up by the sucker 124 is conveyed to the surface table 110 along the conveying path formed by the shared conveying portion 128, the conveying switch portion 136, and the photopolymer plate conveying portion 130 while being pulled out from the magazine 208. When the photopolymer plate 102 is not adhered to the sucker 124 (when the decision of step 336 is negative), the process proceeds to step 340, retry is set in which, preferably, the suction frame 36 is moved downward again and the photopolymer plate 102 is removed.

When the photopolymer plate 102 is thus removed, in step 342, it is determined as to whether removal of the photopolymer plates 102 requires completion. That is, it is confirmed as to whether a predetermined number of photopolymer plates 102 have been removed. When photopolymer plates 102 are continuously removed (when the decision of step 342 is negative), the process proceeds to step 302 and removal of the interleaf paper 118 prior to removal of a subsequent photopolymer plate 102 is carried out.

As described above, in the sheet feeding section 106, the interleaf paper 118 and the photopolymer plate 102 are more reliably removed alternately from the magazine 208 mounted in the plate accommodating section 104 and conveyed to the plate conveying section 108.

The present embodiment is merely one example of the present invention, and the structure of the sheet feeder of the present invention is not limited to the same. The present embodiment was described using the photopolymer plate 102 as the plate-shaped member, but the present invention can be applied to feeding of various printing plates, for example, pre-sensitized plates (PS plates), in addition to the photopolymer plates 102.

Further, in the present invention, various plate-shaped members can be used in addition to printing plates such as photopolymer plates, and the present invention can also be applied to sheet feeding for removing such plate-shaped members and flexible or light sheet materials such as the interleaf papers 118, of which rigidity is lower than that of the plate-shaped members, when the plate-shaped members and the sheet materials alternate with one another in a stack.

What is claimed is:

1. A sheet feeder in which plate-shaped members and sheet materials in a state of being alternately stacked are removed one by one, comprising:

a pair of side plates;

a suction portion having at least one sucker and which is supported between said side plates in a movable manner in a direction perpendicular to at least one of the plate-shaped members and the sheet materials placed in a stack, and adheres to at least one of the plate-shaped members and the sheet materials due to negative pressure;

a suction fan which is supported between said side plates in a movable manner in a direction perpendicular to at least one of the plate-shaped members and the sheet materials placed in a stack, and when the sheet material is disposed at the uppermost position, said suction fan being operated at a position adjacent to the sheet material and sucking in air in the vicinity of the surface of the sheet material;

an elevator which moves said suction portion and said suction fan in a direction perpendicular to at least one of the plate-shaped members and the sheet materials placed in a stack to thereby elevate at least one of a plate-shaped member and a sheet material, stuck to said suction portion; and a sensor which is provided between said side plates so as to be movable in a direction substantially parallel to a direction in which said suction portion is movable, and detects and determines a state in which said suction portion and at least one of the plate-shaped member and the sheet material contact each other, wherein when the sheet material is disposed at the uppermost position, said suction fan is operated in a state of being moved close to the sheet material so as to adhere the sheet material while the sheet material is pressed by said sucker, and thereafter, negative pressure is applied to said sucker at a predetermined timing to allow said sucker to adhere to the sheet material.

2. A sheet feeder according to claim 1, wherein said suction fan is provided so as to face one end of the sheet material.

3. A sheet feeder according to claim 1, wherein said suction fan is provided in the proximity of at least one of the suckers.

4. A sheet feeding method in which first materials having high rigidity and second materials having flexibility in a state of being alternately stacked are removed one by one from a magazine, comprising the steps of:

(a) making a determination as to whether a material disposed at the uppermost position of the stacked materials is the first material or the second material;

(b) when it is determined that the second material is disposed at the uppermost position, causing at least one sucker to abut against the uppermost material;

(c) sucking in air in the vicinity of the surface of the uppermost material by a suction fan;

(d) moving the suction fan upward by a small distance to separate the uppermost material from the stacked materials;

(e) applying negative pressure to the sucker to cause the sucker to adhere to the uppermost material;

(f) stopping operation of the suction fan;

(g) moving upward the sucker and the suction fan to completely separate the uppermost material from the stacked materials;

(h) delivering the adhered uppermost material to a conveying portion; and (i) stopping application of negative pressure to the sucker.

5. A sheet feeding method according to claim 4, wherein the suction fan is provided so as to face one end of the stacked materials.

6. A sheet feeding method according to claim 4,wherein the suction fan is provided adjacent to the sucker.

* * * * *